US006436169B2

(12) United States Patent
Hirai et al.

(10) Patent No.: US 6,436,169 B2
(45) Date of Patent: Aug. 20, 2002

(54) METHOD OF OPERATING A COPPER SMELTING FURNACE

(75) Inventors: Yushiro Hirai, Ibaragi-ken; Mitsumasa Hoshi, Oita-ken, both of (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/799,265

(22) Filed: Mar. 5, 2001

(30) Foreign Application Priority Data

Mar. 3, 2000 (JP) ..... 2000-058615

(51) Int. Cl.[7] ..... C22B 7/04
(52) U.S. Cl. ..... 75/640; 75/652
(58) Field of Search ..... 75/640, 652

(56) References Cited

U.S. PATENT DOCUMENTS 1,822,588 A * 9/1931 Fowler et al. ..... 423/48
3,682,623 A * 8/1972 Dierckx et al. ..... 75/629
3,857,700 A * 12/1974 Ammann et al. ..... 266/215

FOREIGN PATENT DOCUMENTS

JP 62020841 A * 1/1987 ..... 75/640

* cited by examiner

*Primary Examiner*—Roy King
*Assistant Examiner*—Tima McGuthry-Banks
(74) *Attorney, Agent, or Firm*—Jordan and Hamburg LLP

(57) ABSTRACT

In a method of operating a copper smelting furnace, wherein a ferrous substance containing more than 80 wt. % metallic iron having a specific gravity of 3.0–8.0 and particle diameter of 0.3–15 mm is added to copper smelting slag containing Fe having an oxidation-reduction number of 3+ and to the $Fe_3O_4$ in the intermediate layer, thereby deoxidizing the $Fe_3O_4$ to FeO, the method reduces the $Fe_3O_4$ within the slag layer and the $Fe_3O_4$ generated in the intermediate layer between the slag layer and the matte layer. So that their viscosity is reduced and separation rate is increased, thus increasing the yield rate of useful metal, and the problems that originate in the intermediate layer are eliminated.

2 Claims, 4 Drawing Sheets

METHOD OF OPERATING A COPPER SMELTING FURNACE

BACKGROUND OF THE INVENTION

This invention relates to technology for reducing the amount of $Fe_3O_4$ in slag having a specific gravity of about 3.5–4.0, and in the intermediate layer between the slag and matte, the intermediate layer having a specific gravity of 4.0–5.0, in the setting area of copper smelting. furnace.

Normally, in a copper smelting furnace, pulverized raw copper concentrate and silica sand are blown into the reaction shaft of the furnace along with auxiliary fuel and oxygen-enriched air, and oxidation takes place either in a gaseous-solid state or a gaseous-liquid-solid state. The product of oxidation consists of the matte, in which valuable metals such as copper are condensed, and the slag, which is produced by the slag-making reaction between FeO (produced when iron reacts with oxygen) and $SiO_2$. These are segregated by settling in a receptacle. The slag layer, which has a lower specific gravity, settles at the upper portion of the receptacle, while the matte layer settles in the lower portion.

During the reaction described above, oxygen-enriched air can be applied to the raw copper concentrate at a proportion in excess of or at a proportion less than the desired level, thereby causing variations in the reaction process. In the former case, the oxidation of iron within the raw material proceeds too rapidly, causing a portion of the Fe to oxidize excessively from FeO wherein Fe has an oxidation-reduction number of 2+ to $Fe_3O_4$ wherein the Fe has an oxidation-reduction number of 3+. Because $Fe_3O_4$ has a high melting point, the increase in the proportion of $Fe_3O_4$ within the slag increases its viscosity.

In addition, $Fe_3O_4$ has a high specific gravity and forms a layer beneath the slag layer which is fused to the slag. If the proportion of $Fe_3O_4$ is high enough, this layer becomes clearly distinguishable from the slag layer. Since this layer is situated in the middle of the slag layer and the matte layer, it is known as the "intermediate layer." As stated before, an increase in the production of $Fe_3O_4$ as a result of variations in the reaction process leads to an increase in the thickness of the intermediate layer, which interferes with the segregation of valuable metals drifting within the slag layer.

In addition, oxidized matter formed excessively during variations in the reaction can turn into powdered dust, which can be pulled into the exhaust gas and drawn into the gas exhaust openings, creating accretion, part of which can then be retained and sink to the bottom of the receptacle, creating a buildup that lessens the holding capacity of the receptacle.

Thus, as described above, production of $Fe_3O_4$ resulting from variations in the reaction can cause loss of valuable metal drifting within the slag layer and difficulties in closing the slag tap hole, as well as affect the temperature of the slag and the matte and the quantity of the valuable metal in the matte layer, thus causing undesirable effects in later processes.

Hence, there was a need to find a method to deoxidize the $Fe_3O_4$ within the slag and the intermediate layers to FeO, thus decreasing the viscosity of the slag and reducing the amount of $Fe_3O_4$ within the intermediate layer.

Previously, the $Fe_3O_4$ at the lower portion of the receptacle was deoxidized to FeO by introducing blocks of pig iron (ingots shaped 280 mm L×80 mm W×50 mm H, 5 kgs in weight, specific gravity of 7.0 to 7.8) from the upper portion of the receptacle and allowing them to sink to the bottom. However, with this method, the pig iron block does not remain in the slag and intermediate layers but sinks to the bottom of the receptacle, and thus is not effective in deoxidizing $Fe_3O_4$ in these layers. The present invention is based upon a relation between specific gravity and grain size of material effective for the deoxidization of $Fe_3O_4$ such that the material remains within the slag and the intermediate layers, whereby the deoxidization of $Fe_3O_4$ is effected.

SUMMARY OF THE INVENTION

The present invention comprises a method of operating a copper smelting furnace wherein a ferrous substance containing more than 80 wt. % metallic iron, having a specific gravity of 3.0–8.0 and particle diameter of 0.3–15.0 mm, is added to copper smelting slag. The ferrous substance is added to the $Fe_3O_4$ in the intermediate layer, thereby deoxidizing the $Fe_3O_4$ to FeO. More specifically, the present invention comprises a method of operating a copper smelting furnace wherein the ferrous substance specified above is added to the intermediate layer generated between the slag and the matte so as to reduce said intermediate layer.

By employing the present invention, it is possible to reduce the amount of $Fe_3O_4$ within the slag layer and intermediate layer through the simple method of adding grain-shaped matter from above. This allows valuable metals, such as copper, gold and silver drifting within the slag to sink more rapidly, thereby increasing their recovery rate. In addition, various problems in the intermediate layer are reduced, thereby allowing for more efficient operation of the copper smelting furnace.

DETAILED DESCRIPTION OF THE INVENTION

The present invention is described in detail below.

Figure 1:
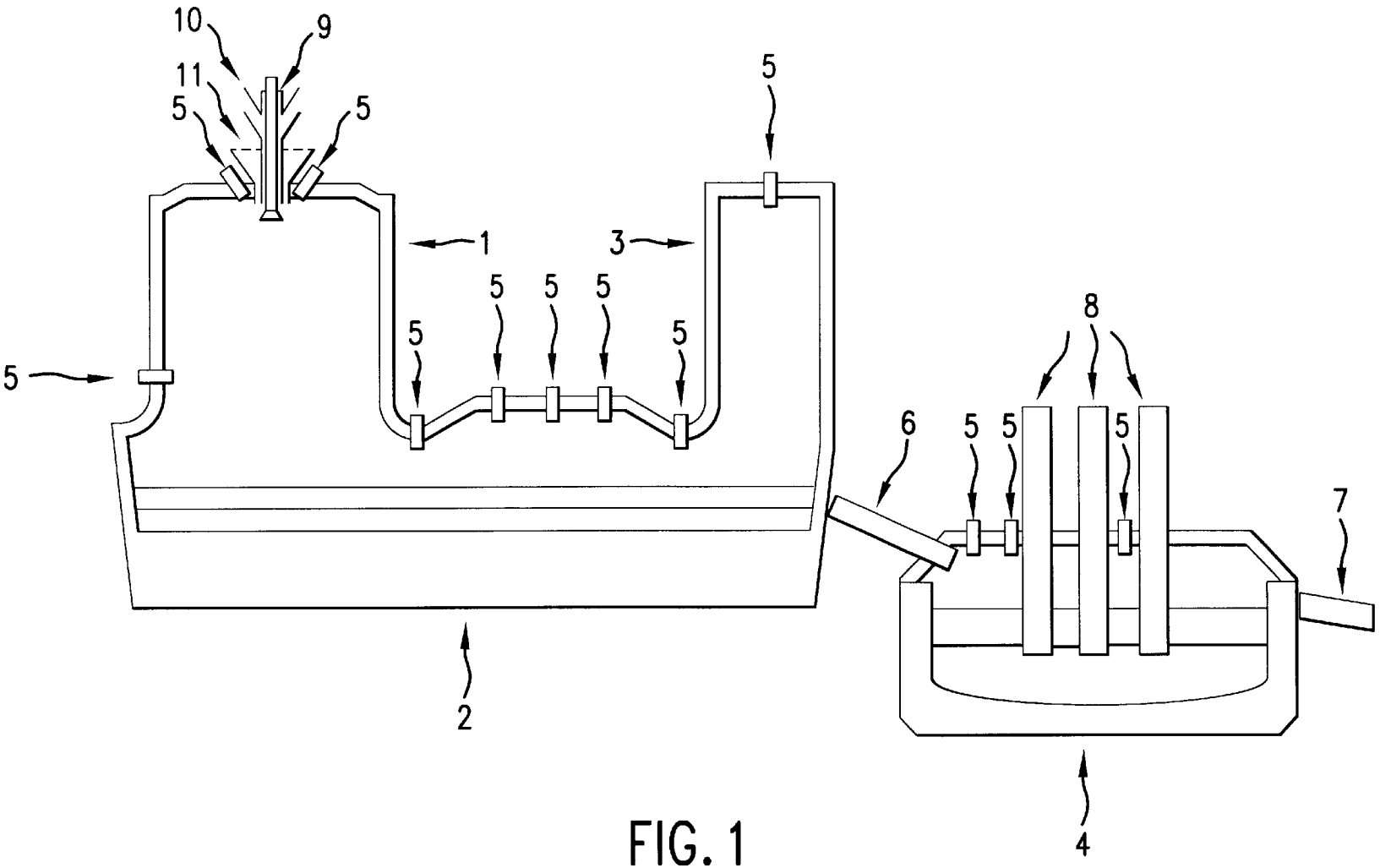
FIG. 1 is a side view of a flash furnace and a slag-cleaning furnace.

As an example of a copper smelting furnace, FIG. 1 is a side view of an Outokumpu flash furnace and slag-cleaning furnace used at Nippon Mining and Metals Saganoseki Smelter & Refinery.

The flash furnace is comprised of three parts: a reaction shaft 1 having a burner 9 in the middle of the ceiling, a settler 2, and an exhaust pipe. The slag extracted from the settler 2 is passed to the slag-cleaning furnace 4 through the launder 6, where it is kept warm by resistance heating using S öderberg electrodes 8. The settler 2 and the slag-cleaning furnace 4 both serve as receptacles, and the slag and matte are segregated by their difference in specific gravity. In both furnaces the matte is drawn out through matte tap holes located at the lower portion of the furnace, and the slag is drawn out through slag tap holes located in the upper portion of the furnace. In addition to the furnace described above, where the slag is further treated in a slag-cleaning furnace 4 after being treated in the flash furnace, there are many types of copper smelting furnaces and methods which use them. Most of them are based on a combination of a reaction shaft where raw copper concentrate is oxidized, and a settling receptacle where the products are allowed to settle and segregate into matte and slag, but there are some types of smelting furnaces where the reaction takes place within the settling receptacle. The present invention applies to all types of copper smelting furnaces that employ a settling receptacle wherein matte and slag are segregated by differences in specific gravity.

In the case of the flash furnace, raw copper concentrate mixture and oxygen-enriched air are blown into the burner 9, and fall through the reaction shaft 1 as the reaction proceeds, the raw copper concentrate mixture, which contains sulfuric material, transforms into matte, slag, and a portion of the exhaust gas by the time it reaches the bottom of the reaction shaft 1. A portion of the products of this reaction are pulled into the flow of the exhaust gas and fly toward the exhaust opening, and is known as "dust."

The matte and slag that form within the reaction shaft 1 are segregated by differences in specific gravity within the settler 2. The slag is drawn out through the slag launder 6 of the flash furnace and is further divided into slag and matte in the slag-cleaning furnace 2. This slag is then drawn out through the slag-cleaning furnace's slag launder 7. For reference, the specific gravity of the matte is 5.0–5.5, the slag is 3.6–4.0, and the intermediate layer is 4.0–5.0.

Deoxidizing agents having the specific gravity and grain size to be retained within the slag and intermediate layers, namely a ferrous substance containing more than 80 wt. % metallic iron, having a specific gravity of 3.0–8.0and particle diameters of 0.3–15 mm, or, to specify the composition in more detail, a ferrous substance containing Fe at 90–97 wt. % and C at 3–6 wt. %, having a specific gravity of 3.0–8.0 and particle diameters of 0.3–15 mm, such as pig iron, is added from above the slag. The word particles, as used in this specification, refers to both particles and grains of particulate matter. Ferrous substances containing 60–80 wt. % metallic iron are also effective in deoxidizing the $Fe_3O_4$ to FeO, though the rate of deoxidization per kilogram is reduced. Openings 5 for adding deoxidizing agents are mounted at various points in the settler 2 and the slag-cleaning furnace 4, and are adjusted according to the conditions of the slag layer and the intermediate layer.

It is desired that the ferrous substance have a specific gravity of about 3.0–8.0. If the specific gravity is less than 3.0, the substance does not satisfactorily reach the intermediate layer, thus only deoxidizing the $Fe_3O_4$ within the slag layer, which is not desired. If the specific gravity is greater than 8.0, the substance penetrates to the matte layer or to the bottom of the furnace, promoting the erosion of the bricks at the bottom of the furnace, which is not desired. The grain size of 0.3–15.0 mm again allows the ferrous substance to be retained within the slag layer and reach the intermediate layer, and deoxidizes the $Fe_3O_4$ within the slag and the intermediate layers without reaching the matte layer. This deoxidization reaction reduces the amount of $Fe_3O_4$ within the slag layer and the intermediate layer, thus lowering the viscosity of the slag layer and reducing the intermediate layer.

The following is a list of the items identified by reference numerals in the Figures provided.

1. reaction shaft
2. settler
3. uptake
4. slag-cleaning furnace
5. opening for inserting deoxidizing agent
6. slag launder
7. slag launder
8. Soderberg electrodes
9. concentrate burner
10. opening for inserting raw material
11. opening for blowing in oxygen-enriched air
12. slag
13. crucible
14. outside crucible
15. thermoelectric thermometer
16. tube for blowing in nitrogen
17. lid of crucible
18. chute for inserting deoxidizing agent
19. bricks for adjusting position
20. Siliconit furnace

EXAMPLE 1

Figure 2:
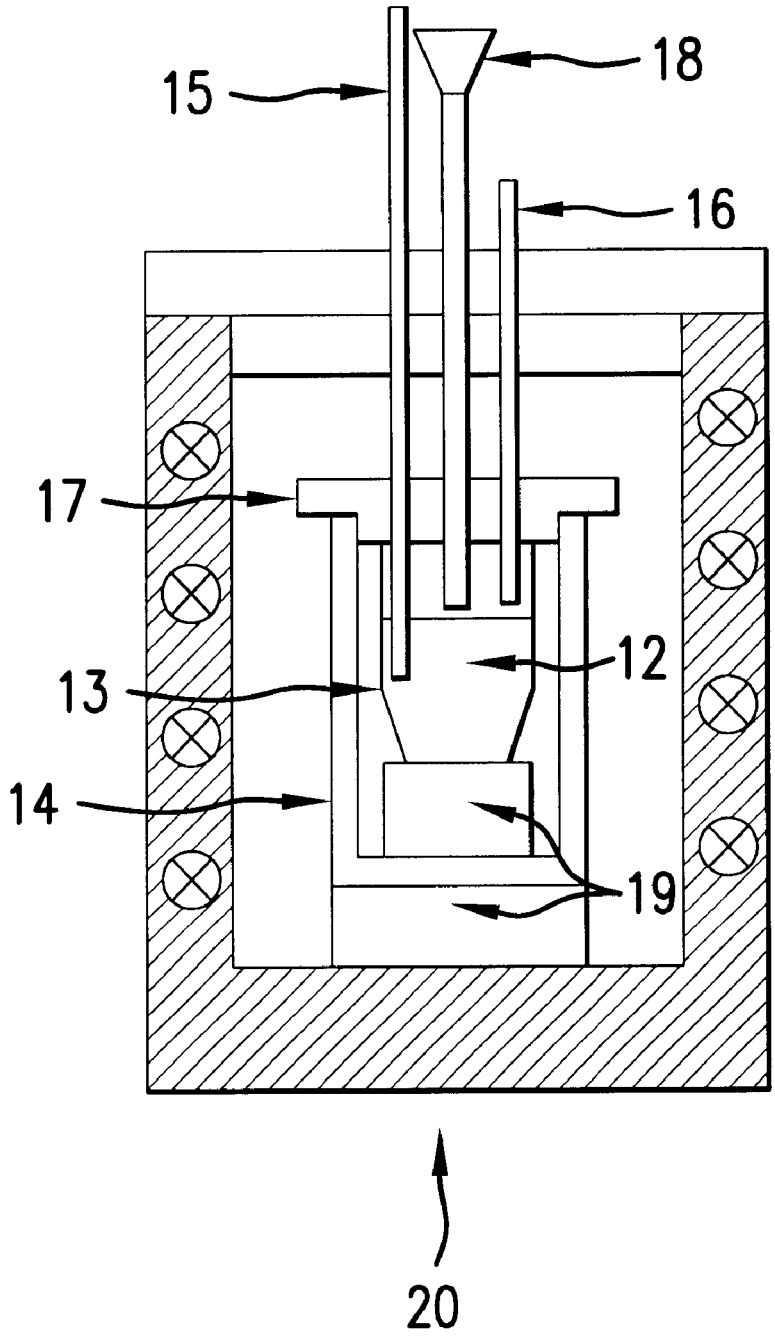
FIG. 2 is a schematic diagram of a crucible test.
Figure 3:
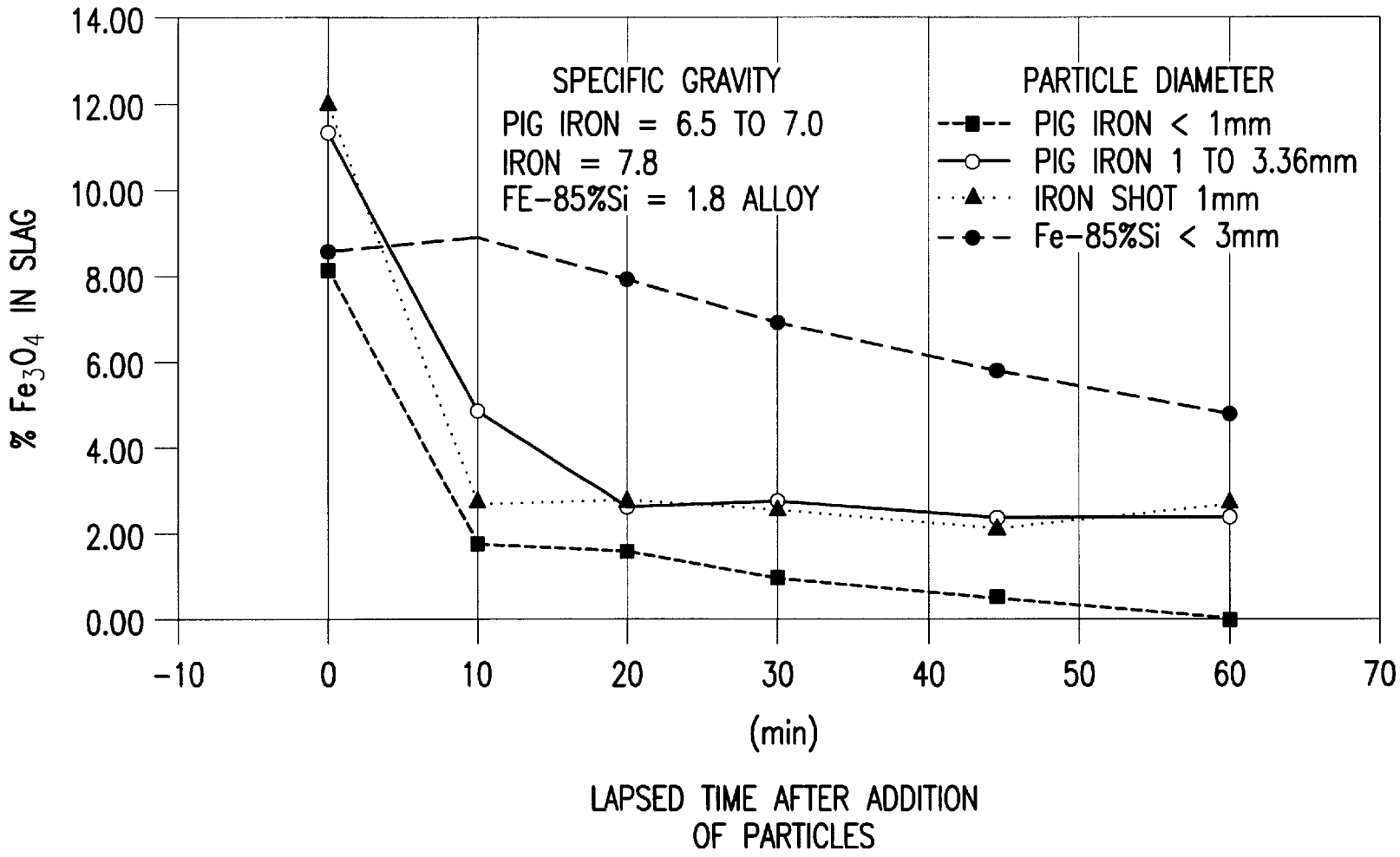
FIG. 3 is a graph of crucible test results.

As an example of an application of the present invention, we relate an experiment performed by melting slag containing $Fe_3O_4$ in a crucible 13, and adding pig iron particles to its surface. This experiment was performed using equipment as described in FIG. 2. 800 g of slag 12 were placed within the crucible 13 and the slag 12 was melted within a nitrogen atmosphere simulating the inside of a flash furnace. Once the temperature reached 1270° C., the temperature was maintained for thirty minutes, after which 16 g of grains of pig iron (specific gravity 5.0–7.0) were added, and samples were taken periodically from the middle portion of the crucible to measure the deoxidization rate. The slag 12 within the crucible 13 was not stirred at all after the addition of pig iron, and was maintained at a temperature of 1270° C. for 60 minutes. This experiment was repeated with different sized grains of pig iron. As typical examples, FIG. 3 shows the results of two tests that were conducted, one with grain particles under 1 mm and one with grain particles between 1.00–3.36 mm. In both cases, the amount of $Fe_3O_4$ within the slag showed a reduction of 70–80 wt. % 20 minutes after the addition, clearly demonstrating the deoxidization effects of pig iron particles. The effects were more pronounced with particles with grain size under 1 mm. Also, iron shot having a 1 mm diameter showed the same effects as pig iron particles having a 1 mm–3.36 mm diameter.

EXAMPLE 2

Next, tests were conducted to confirm the deoxidization effects within an actual furnace. In this test, 50 kg of pig iron particles were added to the upper surface of the slag layer from a measuring hole (not shown) in the roof of the settler 2, positioned in the center of the settler 2, relative to the direction of the slag flow.

The matte layer, intermediate layer, and slag layer were distinguished by inserting a steel measuring rod having a diameter of 30 mm and longer than the required length from the top of the settler 2 into the metal slag inside the settler 2, then withdrawing it after a specified time. The various layers are distinguished by observing the materials adhering to the measuring rod. This is a widely-used measuring method that has been used for a long time in distinguishing slag and matte layers within a copper furnace.

Figure 4A:
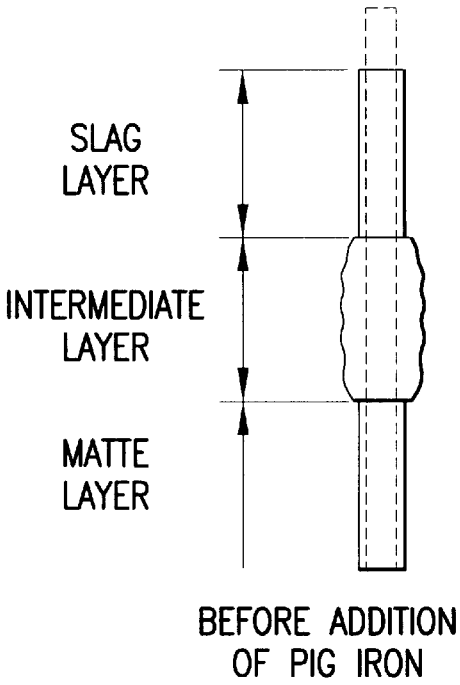
FIGS. 4A and 4B are illustrations of the difference in measurement of the layers in the settler before and after the addition of pig iron grains.
Figure 4B:
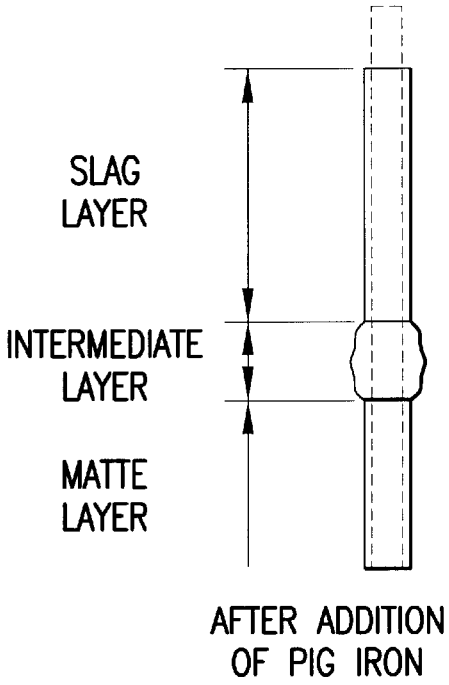

Changes in the materials adhering to the measuring rod are shown in FIGS. 4A and 4B. The intermediate layer, which has high viscosity, adheres thickly to the measuring rod, creating an uneven surface containing matte and half-melted matter. The matte layer, on the other hand, flows easily and only a thin deposit thereof adheres to the measuring rod and it has a smooth surface. A relatively thick deposit of the slag layer adheres to the rod, but the surface is smooth.

Two tests were conducted involving the adding of pig iron particles, and as shown in FIGS. 4A and 4B the intermediate layer was 200 mm and 170 mm respectively before the addition of pig iron particles. Fifteen to twenty minutes later, the intermediate layer had been respectively reduced to 100 mm and 80 mm, or by approximately half, and what had been the upper portions of the intermediate layer had become distinguishable from the slag layer, thus clearly demonstrating the reduction of the intermediate layer.

COMPARATIVE EXAMPLE 3

As shown in FIG. 3, ferro silicon containing 8.5 wt. % Si having a grain size under 3 mm showed little deoxidization effect, perhaps because the specific gravity, at 1.8, is low.

COMPARATIVE EXAMPLE 4

With the prior method of adding pig iron blocks, effects such as those described above are not obtained, since the pig iron blocks are not retained within the slag layer and the intermediate layer.

By employing the present invention, it is possible to reduce the amount of $Fe_3O_4$ within the slag layer and intermediate layer through the simple method of adding grain-shaped matter from above. This allows valuable metals, such as copper, gold and silver drifting within the slag to sink more rapidly, thereby increasing their recovery rate. In addition, various problems induced by the presence of the intermediate layer are reduced, allowing for more efficient operation of the copper smelting furnace.

What is claimed is:

1. A method of operating a copper smelting furnace, comprising adding a ferrous substance containing more than 80 wt. % metallic iron having a specific gravity of 3.0–8.0 and a particle diameter of 0.3–15.0 mm to copper smelting slag containing Fe having an oxidation-reduction number of 3+ and also to $Fe_3O_4$ in an intermediate layer, thereby deoxidizing the $Fe_3O_4$ to FeO.

2. A method of operating a copper smelting furnace according to claim 1, wherein the intermediate layer is located between the slag and a matte layer.

* * * * *